US006352571B1

(12) United States Patent
Waldenström et al.

(10) Patent No.: US 6,352,571 B1
(45) Date of Patent: Mar. 5, 2002

(54) METHOD OF MAKING METAL COMPOSITE MATERIALS

(75) Inventors: Mats Waldenström, Bromma; Rolf Svensson, Hägersten, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/204,354

(22) Filed: Dec. 4, 1998

(30) Foreign Application Priority Data

Dec. 22, 1997 (SE) ..... 9704847

(51) Int. Cl.[7] ..... B22F 9/24

(52) U.S. Cl. ..... 75/351; 75/362; 75/365; 423/58; 423/140

(58) Field of Search ..... 75/351, 362, 365; 423/58, 140

(56) References Cited

U.S. PATENT DOCUMENTS 4,182,627 A * 1/1980 Hardwick et al. ..... 75/365
5,505,902 A 4/1996 Fischer et al. ..... 419/10
5,632,824 A * 5/1997 Grenthe et al. ..... 75/351

FOREIGN PATENT DOCUMENTS

WO WO 96/24454 8/1996
WO WO 97/11804 4/1997

* cited by examiner

*Primary Examiner*—George Wyszomierski
(74) *Attorney, Agent, or Firm*—Burns, Doane, Swecker & Mathis, L.L.P.

(57) ABSTRACT

One or more metal salts of at least one iron group metal containing organic groups are dissolved in at least one polar solvent and complex bound with at least one complex former comprising functional groups in the form of OH or $NR_3$, (R=H or alkyl). In addition, at least one insoluble, reducible salt of at least one iron group metal is suspended in the solution. Hard constituent powder and, optionally, a soluble carbon source are added to the solution. The solvent is evaporated and the powder mass is heat treated in inert and/or reducing atmosphere. As a result, a powder mixture is obtained which, after addition of a pressing agent, can be compacted and sintered according to standard practice to form a body containing hard constituents in a binder phase.

12 Claims, 1 Drawing Sheet

METHOD OF MAKING METAL COMPOSITE MATERIALS

BACKGROUND OF THE INVENTION

The present invention relates to a method of producing metal composite materials such as cemented carbide.

U.S. Pat. No. 5,505,902 discloses a method in which one or more metal salts of at least one iron group metal containing organic groups are dissolved in at least one polar solvent such as ethanol, methanol, water and complex bound with at least one complex former comprising functional groups in the form of OH or $NR_3$, (R=H or alkyl). Hard constituent powder and, optionally, a soluble carbon source are added to the solution. The solvent is evaporated and the remaining powder is heat treated in an inert and/or reducing atmosphere. As a result, hard constituent powder coated with at least one iron group metal is obtained which, after the addition of a pressing agent, can be compacted and sintered according to standard practice, to form a body containing hard constituents in a binder phase. A disadvantage with the mentioned method is that the solution generally contains rather low amounts of the iron group metal which leads to large volumes of solution and thus long evaporation times when coating hard constituent powders with high binder content. Therefore, a hard constituent powder containing less than 5% binder phase is generally made and to this powder is added more binder metal powder to the desired final composition. This requires an additional process step and rather careful mixing in order to obtain an even microstructure.

OBJECTS AND SUMMARY OF THE INVENTION

It is an object of this invention to avoid or alleviate the problems of the prior art.

It is further an object of this invention to provide a method of producing metal composite materials such as cemented carbide.

It is an aspect of the invention to provide a method of making a hard constituent powder mixture containing at least one iron group metal comprising the following steps:

- forming a solution by dissolving at least one salt of at least one iron group metal containing organic groups in at least one polar solvent and complex binding with at least one complex former comprising functional groups in the form of OH or $NR_3$, where (R=H or alkyl);
- suspending in the solution at least one insoluble, reducible salt of at least one iron group metal;
- adding hard constituent powder to the solution;
- forming a powder mass by evaporating the solvent; and
- heat treating the powder mass in an inert and/or reducing atmosphere to obtain a powder mixture.

BRIEF DESCRIPTION OF THE DRAWINGS

The FIGURE shows the microstructure of a hard constituent powder at 5000X made according to the process of the present invention.

DETAILED DESCRIPTION OF THE PREFERRED EMBODIMENTS OF THE INVENTION

Figure 1:
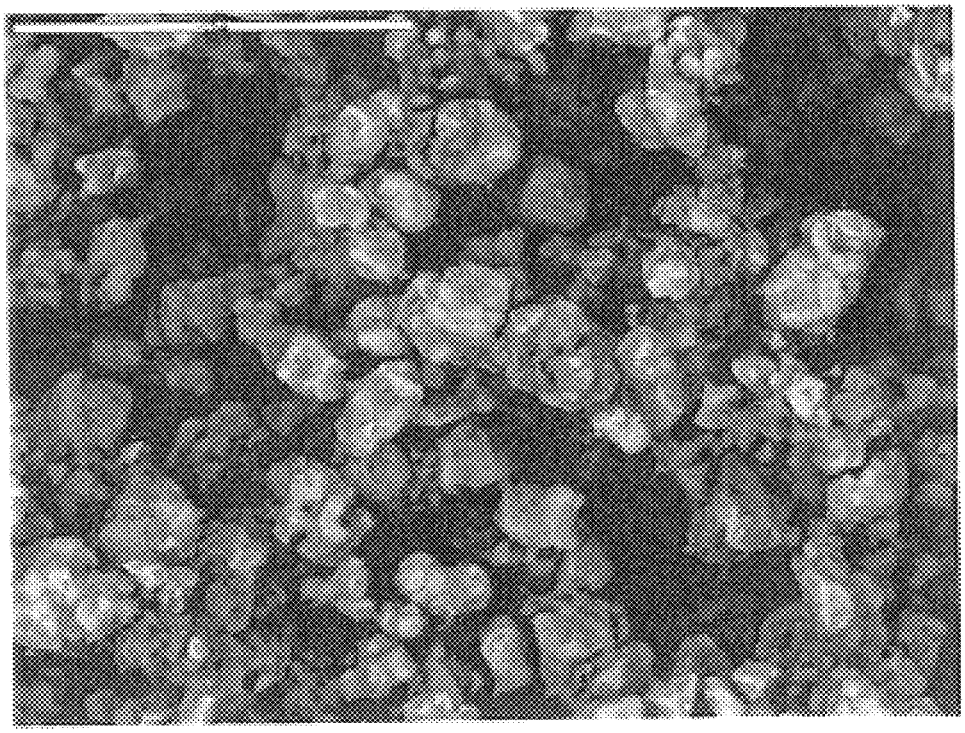

It has now surprisingly been found that if, in addition to soluble salts, an insoluble and reducible salt of the iron group metals is added to achieve the desired composition, it is possible to obtain an even and homogeneous structure of the cemented carbide.

The process according to the present invention comprises the following steps where Me=Co, Ni, Fe and mixtures thereof.

1. At least one salt or compound of Me containing organic or inorganic groups is dissolved in at least one polar solvent such as ethanol, methanol, water, acetonitrile, dimethylformamide or dimethylsulfoxide and combinations of solvents such as methanol-ethanol and water-glycol, preferably methanol and/or water. Optionally, triethanolamine or other complex former, especially molecules containing more than two functional groups, i.e., OH or $NR_3$ (with R=H or alkyl), at a ratio of 0.1–2.0 mole complex former/mole metal, preferably about 0.5 mole complex former/mole metal, is added under stirring.

2. Into the solution is further suspended one or more insoluble and reducible organic or inorganic salts or compounds of Me, preferably hydroxide of Me. Preferably, the salts shall have a grain size <2 $\mu$m.

3. Optionally, sugar ($C_{12}H_{22}O_{11}$) or other soluble carbon source such as other types of carbohydrates and/or organic compounds which decompose under formation of carbon in the temperature range 100°–500° C. in non-oxidizing atmosphere can be added (<2.0 mole C/mole metal, preferably about 0.5 mole C/mole metal), and the solution heated to 40° C. in order to improve the solubility of the carbon source. The carbon is used to reduce the MeO formed in connection with heat treatment and to regulate the C-content in the powder layer.

4. WC powder and optionally other hard constituents powders, preferably well-deagglomerated, e.g., by jet milling, are added under moderate stirring and the temperature is increased to accelerate the evaporation of the solvent. When the mixture has become rather viscous, the dough-like mixture is kneaded and when almost dry, smoothly crushed in order to facilitate the evaporation (avoiding inclusions of solvent).

5. The loosened powder lump obtained in the preceding step is heat treated in nitrogen and/or hydrogen at about 400°–1100° C., preferably 400°–800° C. To achieve a fully reduced powder, a holding temperature might be needed. The time of heat treatment is influenced by process factors such as powder bed thickness, batch size, gas composition and heat treatment temperature and has to be determined by experiments well within the purview of the artisan. A holding time for reduction of a 5 kg powder batch in a pure hydrogen atmosphere at 500° C. for 60–120 minutes has been found suitable. Nitrogen and/or hydrogen is normally used but Ar, $NH_3$, CO and $CO_2$ (or mixtures thereof) can be used whereby the composition and microstructure of the powder can be modulated.

6. After the heat treatment, the powder is mixed with a conventional pressing agent in ethanol to form a slurry either alone or with other coated hard constituent powders and/or binder phase metals and/or carbon to obtain the desired composition. The slurry then is dried, compacted and sintered in the usual way to obtain a sintered body of hard constituents in a binder phase.

Most of the solvent can be recovered.

Alternatively, the pressing agent can be added together with the hard constituent powder according to paragraph 3 above, directly dried, pressed and sintered.

The invention has been described with reference to the iron group metals. It is obvious that it can be applied also to other metals of group VIII.

The invention is additionally illustrated in connection with the following Examples which are to be considered as illustrative of the present invention. It should be understood, however, that the invention is not limited to the specific details of the Examples.

EXAMPLE 1

A WC-10% Co cemented carbide was made in the following way according to the invention: 84 g cobalt acetate tetrahydrate ($Co(C_2H_3O_2)_2.4H_2O$) was dissolved in 1200 ml methanol ($CH_3OH$). 126 g cobalt hydroxide ($Co(OH)_2$) was added to the solution. To this solution, 30 g triethanolamine ($(C_2H_5O)_3N$) was added during stirring. After that, 900 g WC ($d_{wc}$=2.1 $\mu$m) was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous bed about 1 cm thick in nitrogen atmosphere in a closed vessel at a heating rate of 10° C./min to 500° C. The reduction was completed in hydrogen for 90 minutes, followed finally by cooling in a nitrogen atmosphere at 10° C./min. No cooling step between burning off and reduction step was used.

The powder obtained was mixed with a pressing agent in ethanol with adjustment of carbon content (carbon black), dried, compacted and sintered according standard practice for WC—Co alloys. A dense cemented carbide structure with porosity A00 and hardness HV3=1320 was obtained. The FIGURE shows the microstructure of the powder at 5000X before mixing.

EXAMPLE 2

A WC-10% Co cemented carbide was made in the same way as in Example 1 but without the addition of triethanolamine ($(C_2H_5O)_3N$) to the solution. The same result as in Example 1 was obtained.

EXAMPLE 3

A WC-10% Co cemented carbide was made in the same way as in Example 1 with 1200 ml water used as the solvent instead of methanol ($CH_3OH$). The same result as in Example 1 was obtained.

EXAMPLE 4

A WC-1.0% TaC-0.3% NbC-10% Co cemented carbide was made in the same way as in Example 1 except for an extra addition of 12.5 g (Ta,Nb)C (80/20). A dense cemented carbide structure with porosity A00 and hardness HV3=1350 was obtained.

EXAMPLE 5

A WC-1.0% TiC-10% Co cemented carbide was made in the same way as in Example 1 except for an extra addition of 20.0 g (W,Ti)C (50/50). A dense cemented carbide structure with porosity A00 and hardness HV3=1330 was obtained.

EXAMPLE 6

A WC-10% Ni cemented carbide was made in the same way as in Example 1 but with nickel acetate tetrahydrate ($Ni(C_2H_3O_2)_2.4H_2O$) and nickel hydroxide ($Ni(OH)_2$) instead of cobalt acetate tetrahydrate ($Co(C_2H_3O_2)_2.4\ H_2O$) and cobalt hydroxide ($Co(OH)_2$). A dense cemented carbide structure with porosity A00 and hardness HV3=1280 was obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a hard constituent powder mixture containing at least 10% of one iron group metal comprising the following steps:

forming a solution by dissolving at least one salt of at least one iron group metal containing organic groups in at least one polar solvent and complex binding with at least one complex former comprising functional groups in the form of OH or $NR_3$, where (R=H or alkyl);

suspending in the solution at least one insoluble, reducible salt of at least one iron group metal;

adding WC powder to the solution;

forming a powder mass by evaporating the solvent; and heat treating the powder mass in an inert and/or reducing atmosphere to obtain a powder mixture.

2. The method of claim 1, wherein the polar solvent is chosen from the group consisting of: ethanol, methanol, water, acetonitrile, dimethylformamide, dimethylsulfoxide, a combination of methanol and water and a combination of glycol and water.

3. The method of claim 1, wherein the complex former comprises triethanolomine.

4. The method of claim 1, wherein the insoluble reducible salt comprises a hydroxide of at least one iron group metal.

5. The method of claim 4, wherein the insoluble, reducible salt has a grain size <2 $\mu$m.

6. The method of claim 1, further comprising the step of adding a soluble carbon source to the solution.

7. The method of claim 6 wherein the soluble carbon source is sugar.

8. The method of claim 6, wherein the solution is heated to 40° C. to improve the solubility of the carbon source.

9. The method of claim 1, wherein the powder mass is heated to a temperature of about 400–1100° C. and the atmosphere contains at least one of $N_2$, $H_2$, Ar, $NH_3$, CO, $CO_2$ and mixtures thereof.

10. The method of claim 1, wherein the powder mass is heated to 500° C. in a pure hydrogen atmosphere for 60–120 minutes.

11. The method of claim 1, further comprising adding a pressing agent and solvent to the powder mixture to form a slurry, drying the slurry, compacting the dried slurry to form a body and sintering the body.

12. The method of claim 11, wherein sintered body has an A00 porosity and a hardness value of HV3=1320.

* * * * *